US011906188B2

(12) United States Patent
Hjortland et al.

(10) Patent No.: US 11,906,188 B2
(45) Date of Patent: Feb. 20, 2024

(54) ENERGY EFFICIENT HEAT PUMP SYSTEMS AND METHODS

(71) Applicant: Johnson Controls Tyco IP Holdings LLP, Milwaukee, WI (US)

(72) Inventors: Andrew Leroy Hjortland, Stoughton, WI (US); Jonathan David Douglas, Mequon, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 18/182,012

(22) Filed: Mar. 10, 2023

(65) Prior Publication Data

US 2023/0288093 A1 Sep. 14, 2023

Related U.S. Application Data

(60) Provisional application No. 63/319,063, filed on Mar. 11, 2022.

(51) Int. Cl.
*F24F 11/67* (2018.01)
*F24F 11/84* (2018.01)

(52) U.S. Cl.
CPC ..... *F24F 11/67* (2018.01); *F24F 11/84* (2018.01)

(58) Field of Classification Search
CPC .. F25B 2400/075; F25B 13/00; F25B 47/025; F25B 2313/0271; F24F 11/67; F24F 11/41; F24F 11/42; F24F 11/43
See application file for complete search history.

(56) References Cited

U.S. PATENT DOCUMENTS 3,077,088 A * 2/1963 Japhet ..... F25B 1/10 62/509
4,787,211 A * 11/1988 Shaw ..... F25B 49/022 417/248
5,142,884 A * 9/1992 Scaringe ..... F02G 1/0435 62/174
10,107,535 B2 10/2018 Taras et al.
(Continued)

FOREIGN PATENT DOCUMENTS

CN 203024347 U 6/2013
CN 105737294 A 7/2016
CN 209855985 U 12/2019

*Primary Examiner* — Nelson J Nieves
(74) *Attorney, Agent, or Firm* — Fletcher Yoder, P.C.

(57) ABSTRACT

An energy efficient heat pump for a heating, ventilation, and air conditioning (HVAC) system includes a compressor system configured to direct a working fluid flow along a working fluid circuit of the energy efficient heat pump. The compressor system includes a first compressor configured to direct the working fluid flow in a first direction along the working fluid circuit and a second compressor configured to direct the working fluid flow in a second direction along the working fluid circuit, opposite the first direction. The energy efficient heat pump also includes a controller communicatively coupled to the first compressor and the second compressor, where the controller is configured to operate the first compressor and suspend operation of the second compressor in a cooling mode of the energy efficient heat pump and to operate the second compressor and suspend operation of the first compressor in a heating mode of the energy efficient heat pump.

20 Claims, 10 Drawing Sheets

(56) References Cited

U.S. PATENT DOCUMENTS

| | | | | |
|---|---|---|---|---|
| 2002/0035840 | A1* | 3/2002 | Kim | F25B 40/02 62/199 |
| 2004/0003604 | A1* | 1/2004 | So | F25B 13/00 62/81 |
| 2006/0225445 | A1* | 10/2006 | Lifson | F25B 1/10 62/175 |
| 2010/0186433 | A1* | 7/2010 | Galante | F04C 18/0215 62/115 |
| 2010/0218528 | A1* | 9/2010 | Yakumaru | F25B 47/022 62/510 |
| 2013/0195678 | A1* | 8/2013 | Yoo | F04D 27/0269 417/45 |
| 2015/0267952 | A1* | 9/2015 | Hung | F25B 49/027 62/115 |
| 2015/0276276 | A1* | 10/2015 | Goel | F25B 49/022 62/115 |
| 2016/0209064 | A1* | 7/2016 | Hrejsa | G05D 23/1904 |
| 2019/0257554 | A1* | 8/2019 | Ito | F25B 41/39 |
| 2019/0293331 | A1* | 9/2019 | Ochiai | F25B 49/02 |
| 2021/0033315 | A1* | 2/2021 | Wallet-Laïly | F25B 13/00 |
| 2021/0302040 | A1* | 9/2021 | Brahme | F24F 11/86 |
| 2022/0011026 | A1* | 1/2022 | Sishtla | F25B 49/022 |
| 2022/0205680 | A1* | 6/2022 | Takegami | F25B 41/20 |
| 2022/0290906 | A1* | 9/2022 | Cai | F25B 49/022 |
| 2023/0129242 | A1* | 4/2023 | Zou | F25B 41/22 62/324.6 |

* cited by examiner

ENERGY EFFICIENT HEAT PUMP SYSTEMS AND METHODS

CROSS REFERENCE TO RELATED APPLICATIONS

This application claims priority to and the benefit of U.S. Provisional Application Ser. No. 63/319,063, entitled "HEAT PUMP CONTROL SYSTEMS AND METHODS," filed Mar. 11, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems with improved operational efficiency. More particularly, embodiments of the present disclosure are directed to reducing energy consumption by employing different compressors configured to operate more efficiently in different HVAC system operating modes, which limits corresponding emissions.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, the HVAC system includes a reversing valve that enables reversal of refrigerant flow through the refrigerant circuit. In this way, the reversing valve enables the condenser to operate as an evaporator (e.g., a heat absorber) and the evaporator to operate as a condenser (e.g., a heat rejector). Accordingly, the HVAC system may operate as a heat pump system in multiple operating modes (e.g., a cooling mode, a heating mode) to provide both heating and cooling to the building with one refrigeration circuit. Unfortunately, implementation of reversing valves in conventional heat pump systems may reduce an overall operational efficiency of the HVAC system. Indeed, existing heat pumps may operate inefficiently in the heating mode, the cooling mode, or both. It is now recognized that such inefficiencies can result in unnecessary energy consumption and associated emissions.

SUMMARY

The present disclosure relates to an energy efficient heat pump for a heating, ventilation, and air conditioning (HVAC) system. The heat pump includes a compressor system configured to direct a working fluid flow along a working fluid circuit of the heat pump. The compressor system includes a first compressor configured to direct the working fluid flow in a first direction along the working fluid circuit and a second compressor configured to direct the working fluid flow in a second direction along the working fluid circuit, opposite the first direction. The heat pump also includes a controller communicatively coupled to the first compressor and the second compressor, where the controller is configured to operate the first compressor and suspend operation of the second compressor in a cooling mode of the heat pump and to operate the second compressor and suspend operation of the first compressor in a heating mode of the heat pump.

The present disclosure also relates to an energy efficient heat pump including a working fluid circuit, a first compressor disposed along the working fluid circuit, where the first compressor is configured to direct a working fluid along the working fluid circuit in a first direction in a first operating mode of the heat pump, and a second compressor disposed along the working fluid circuit, where the second compressor is configured to direct the working fluid along the working fluid circuit in a second direction in a second operating mode of the heat pump. The first compressor and the second compressor are arranged in parallel with one another relative to a flow of the working fluid along the working fluid circuit, and the first direction is opposite the second direction.

The present disclosure further relates to an energy efficient heat pump for a heating, ventilation, and air conditioning (HVAC) system including a first compressor disposed along a working fluid circuit and configured to direct a working fluid through the working fluid circuit in a first direction, and a second compressor disposed along the working fluid circuit and configured to direct the working fluid through the working fluid circuit in a second direction, opposite the first direction. The first compressor and the second compressor are arranged in parallel with one another relative to a flow of the working fluid along the working fluid circuit. The heat pump also includes a controller configured to operate the first compressor and suspend operation of the second compressor in a cooling mode of the heat pump and to operate the second compressor and suspend operation of the first compressor in a heating mode of the heat pump.

DETAILED DESCRIPTION

Figure 1:
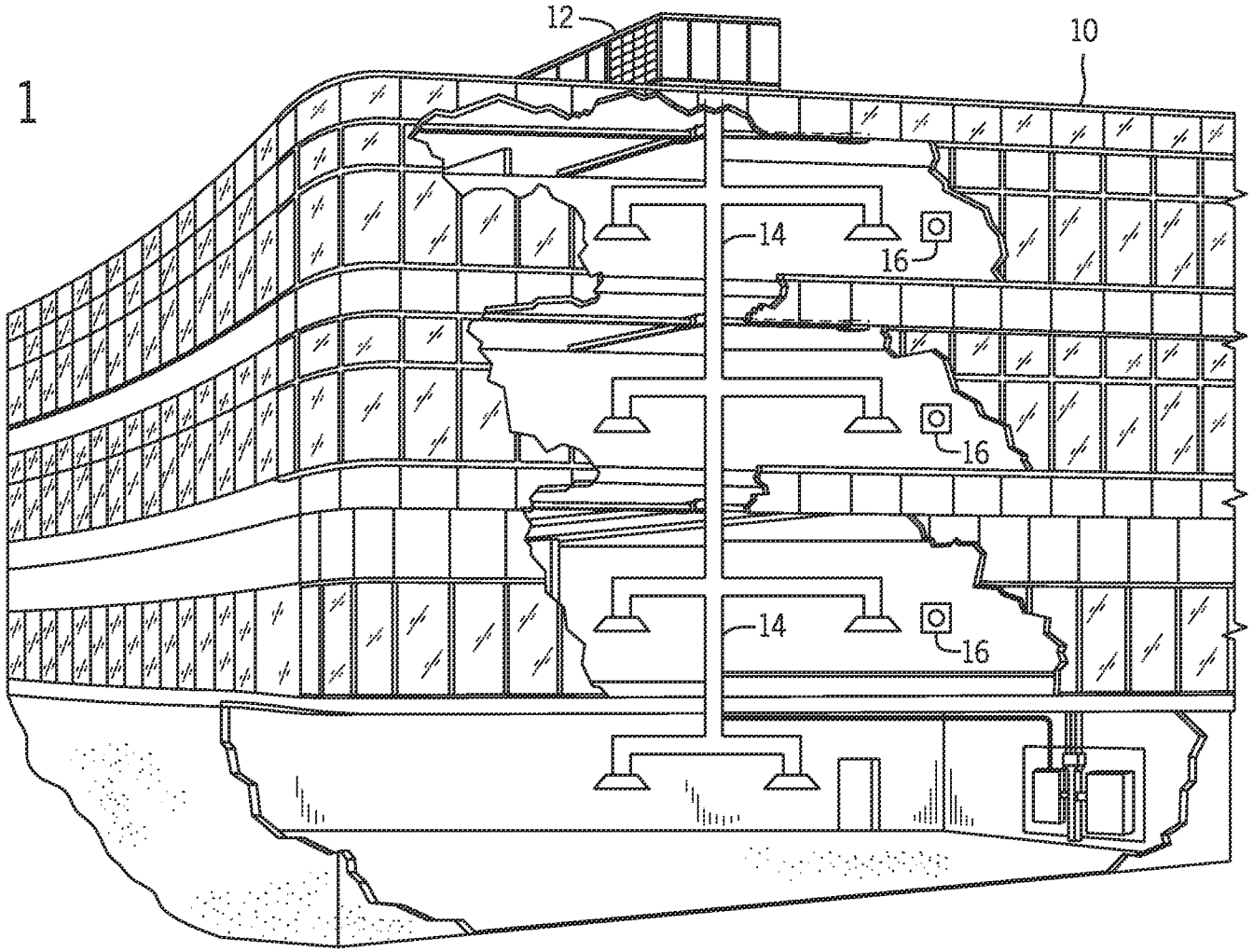
FIG. 1 is a perspective view of an embodiment of a building incorporating a heating, ventilation, and air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit (e.g., refrigerant circuit). A compressor may be used to circulate the working fluid through the conduits and other components of the refrigerant circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load and the ambient environment, for example. The heat pump system is operable to provide both cooling or heating to the space to be conditioned (e.g., a room, zone, or other region within a building) by adjusting a flow of the working fluid through the working fluid circuit. Thus, the heat pump may not include a dedicated heating system, such as a furnace or burner configured to combust a fuel, to enable operation of the HVAC system in the heating mode. As a result, the heat pump operates with reduced greenhouse gas emissions.

For example, during operation of the heat pump system in a cooling mode, the compressor may direct working fluid through the working fluid circuit and the first and second heat exchangers in a first flow direction. While receiving working fluid in the first flow direction, the first heat exchanger (which may be positioned within the space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (i.e., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the current operational mode of the heat pump system (e.g., based on a flow direction of refrigerant along the working fluid circuit).

Unfortunately, implementation of the reversing valve in the heat pump system may increase manufacturing complexity and/or overall manufacturing cost of the HVAC system. Moreover, in some cases, inclusion of the reversing valve in the heat pump system may cause a pressure drop along the working fluid circuit that may adversely affect an operational efficiency of the HVAC system. Further, the reversing valve may incur wear or performance degradation over time, which may result in reduced operational reliability of the HVAC system. For example, upon occurrence of a fault condition in the reversing valve, operation of the HVAC system may be temporality suspended until an operator (e.g., a service technician) performs maintenance, repair, and/or replacement of the reversing valve.

Moreover, utilization of a compressor for operating the heat pump in both the cooling mode and the heating mode (e.g., via cooperation with the reversing valve) may result in a reduction in an overall operational efficiency of the HVAC system. Indeed, performance (e.g., efficiency) of the heat pump may be affected by a type, design, or other characteristic of the compressor utilized in the heating mode and the cooling mode. For example, in many cases, pressure differentials or pressure ratios across various components (e.g., the compressor) or sections of the working fluid circuit may vary based on the mode (e.g., cooling, heating) in which the heat pump system operates. As an example, pressure ratios across the compressor of the working fluid circuit may be relatively small while the heat pump system operates in the cooling mode and may be relatively large while the heat pump system operates in the heating mode. In particular, such pressure ratios may be indicative of a differential between an entering working fluid pressure at an inlet of the compressor and an exiting working fluid pressure at an outlet of the compressor.

Typically, a volume index (e.g., a volume ratio) of the compressor coupled to the working fluid circuit may be fixed (e.g., invariable), which may cause the compressor to be ill-suited or incapable of adjusting working fluid compression and working fluid circulation along the working fluid circuit in response to the varying pressure differentials that may be encountered between operation in the cooling and heating modes of the heat pump system. In some cases, certain compressors may be ill-suited and/or inefficient for certain HVAC system applications (e.g., based on amounts of heating and cooling typically desired in a particular HVAC system application). For example, a heating load of a heat pump may be greater in a cold climate than in a warm climate, but a cooling load of the heat pump in the same cold climate may be lower. In such applications, the heat pump may include a compressor that operates adequately in a heating mode to satisfy a greater heating demand in the cold climate, but the compressor may operate inefficiently in a cooling mode (e.g., the compressor cycle on and off more frequently in the cooling mode, which may reduce a useful life of the compressor). For at least the foregoing reasons, conventional compressor and reversing valve systems may limit an overall operational efficiency of the HVAC system throughout a duration in which the heat pump system operates in the cooling mode, the heating mode, or both (e.g., based on an instant position of the reversing valve). As such, it is presently recognized that removal of a reversing valve from the working fluid circuit of the heat pump system and utilization of different compressors for different operating modes of the heat pump may mitigate or substantially eliminate the aforementioned shortcomings of conventional HVAC systems.

Accordingly, embodiments of the present disclosure relate to a heat pump system that is configured to selectively operate in both a cooling mode or a heating mode without implementation of a reversing valve. That is, the heat pump system of the present disclosure excludes a reversing valve disposed along the working fluid circuit (e.g., between heat exchangers and a compressor or compressor system of the HVAC system). As such, implementation of the disclosed heat pump systems may improve the overall operational efficiency (e.g., with reduced energy consumption) of the HVAC system during cooling and heating operations, as well as reduce costs and complexity associated with operation and/or maintenance of the HVAC system.

For example, embodiments of the heat pump system disclosed herein may include a first compressor (or a first group of compressors) and a second compressor (or a second group of compressors) that are fluidly coupled to the working fluid circuit (e.g., in a parallel configuration). The first compressor may be coupled to and oriented along the working fluid circuit such that, during operation of the first compressor, the first compressor directs working fluid through heat exchangers (e.g., a condenser, an evaporator) and an expansion valve (e.g., an electronic expansion valve [EEV]) of the heat pump system in a first direction to enable operation of the heat pump system in the cooling mode. The second compressor may be coupled to and oriented along the working fluid circuit such that, during operation of the second compressor, the second compressor directs working fluid through heat exchangers and the expansion valve of the heat pump system in a second direction (e.g., opposite the first direction) to enable operation in the heating mode. The first compressor (e.g., one or more compressors) may include operational characteristics (e.g., a volume index or compression ratio, a capacity, a power output) that facilitate enhanced operation (e.g., reduced energy consumption) of the heat pump system in the cooling mode, while the second compressor (e.g., one or more compressors) may include operational characteristics that facilitate enhanced operation (e.g., reduced energy consumption) of the heat pump system in the heating mode. A controller of the heat pump system may be configured to selectively operate the first compressor or the second compressor based on a desired operational mode of the heat pump system (e.g., cooling mode, heating mode, defrost mode). In this way, the controller is configured to enable switchable operation of the heat pump system in the cooling mode or the heating mode (e.g., between the cooling mode and the heating mode) without involving inclusion and operation (e.g., activation, adjustment, control) of a reversing valve.

As an example, upon receiving a call (e.g., a control instruction) to operate the heat pump system in the cooling mode, the controller may activate the first compressor and may retain the second compressor in an idle (e.g., inactive) state. In this way, the controller may operate the first compressor to direct working fluid through the heat exchangers of the heat pump system in a first direction, thereby enabling operation of the heat pump system in the cooling mode. Conversely, upon receiving a call to operate the heat pump system in the heating mode, the controller may activate the second compressor and may retain the first compressor in the idle state. As such, the controller may operate the second compressor to direct working fluid through the heat exchangers of the heat pump system in a second direction to enable operation of the heat pump system in the heating mode. Indeed, heat pumps incorporating the present techniques are configured to heat an air flow in an energy efficient manner and without operation of a furnace or other heating system configured to combust or consume a fuel and thereby provide a reduction of greenhouse gas emissions.

As discussed in detail below, the controller may selectively operate individual compressors, combinations of compressors, and/or additional components (e.g., valves, fans, blowers, etc.) included in the heat pump system in accordance with the presently disclosed techniques. Moreover, it should be understood that one or more of the compressors included in the heat pump system may be fixed speed compressors, multi-stage (e.g., two stage) compressors, and/or variable speed compressors. These and other features will be described below with reference to the drawings.

Turning now to the drawings, FIG. 1 illustrates an embodiment of a heating, ventilation, and air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
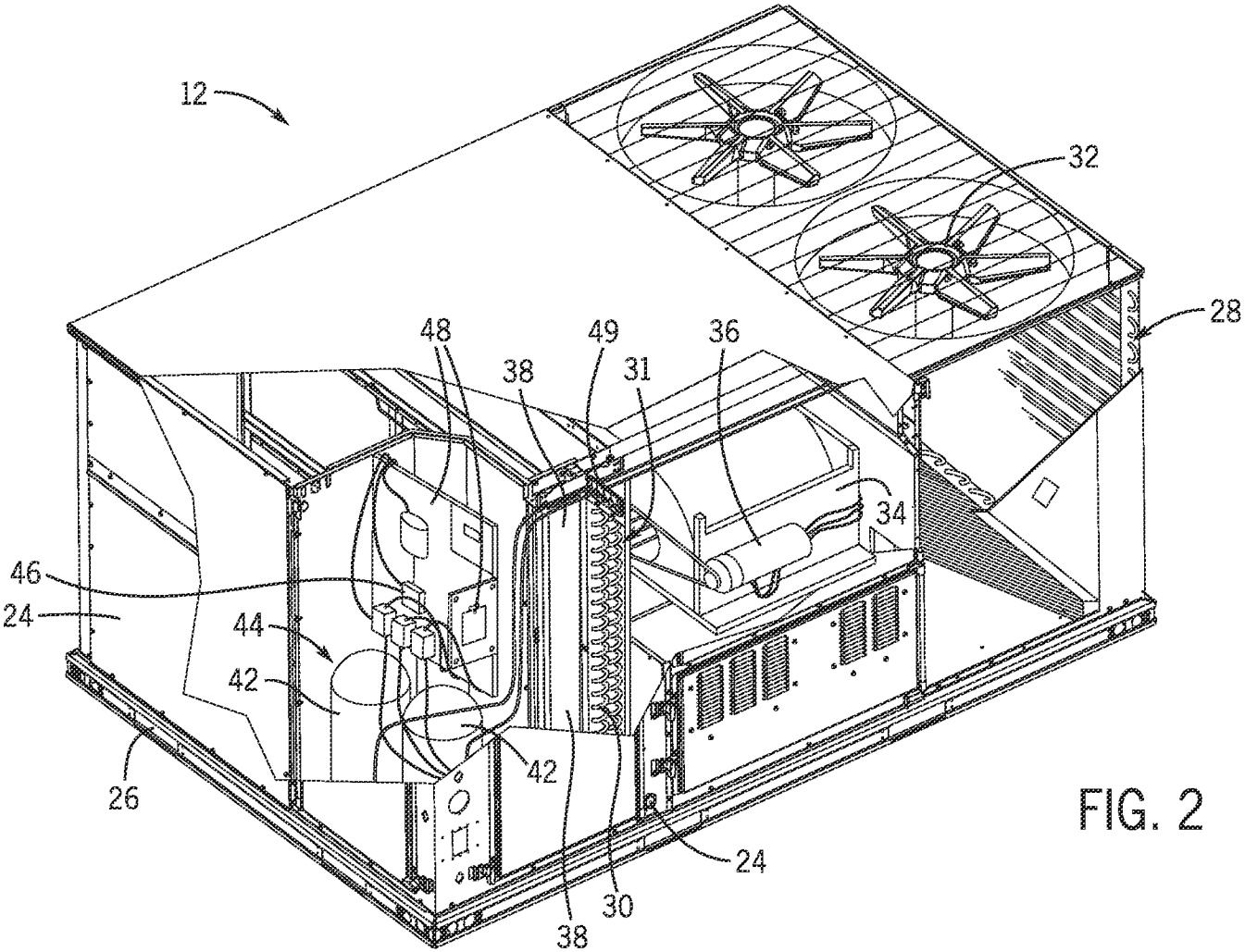
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits (e.g., working fluid circuits) and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multi-channel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
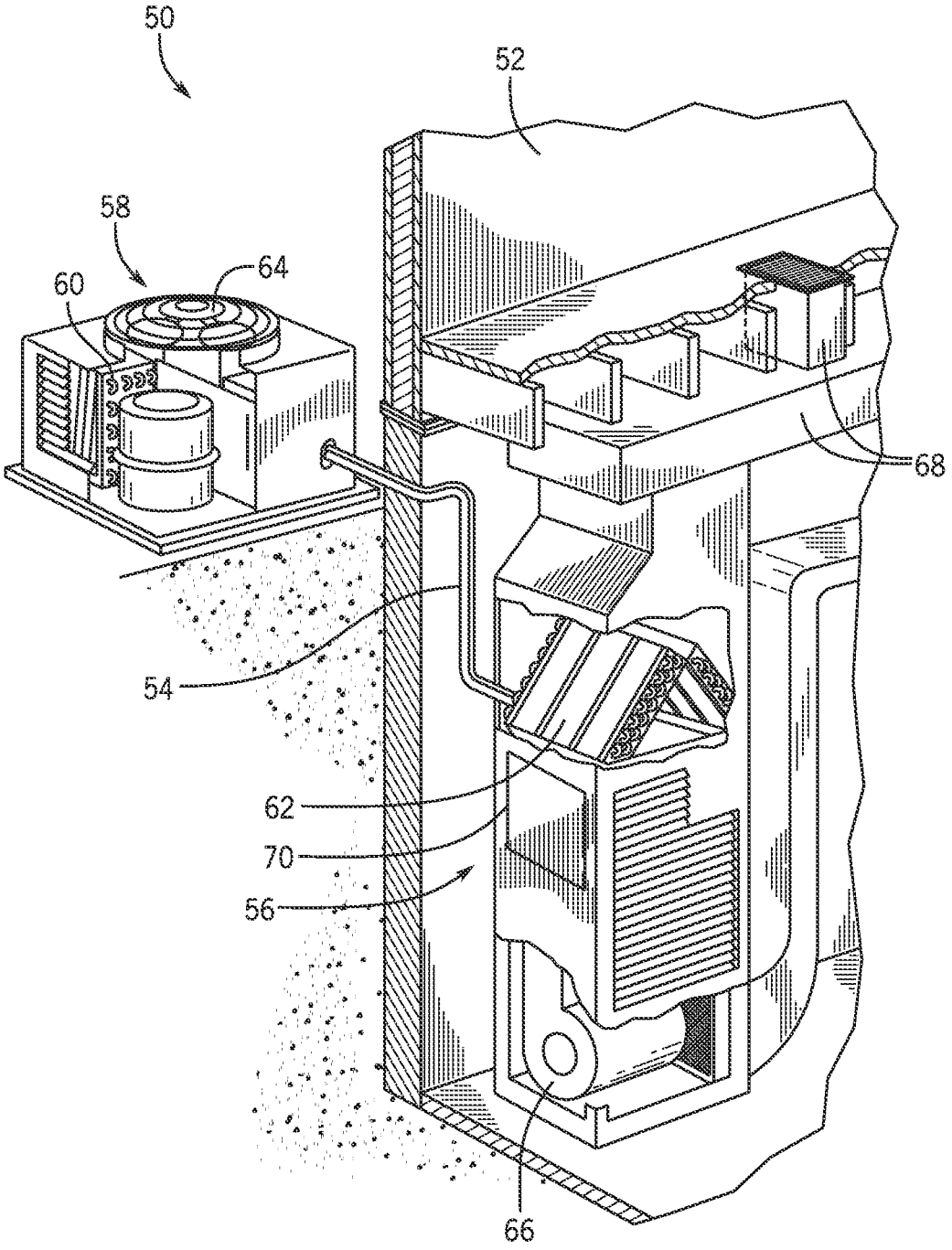
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
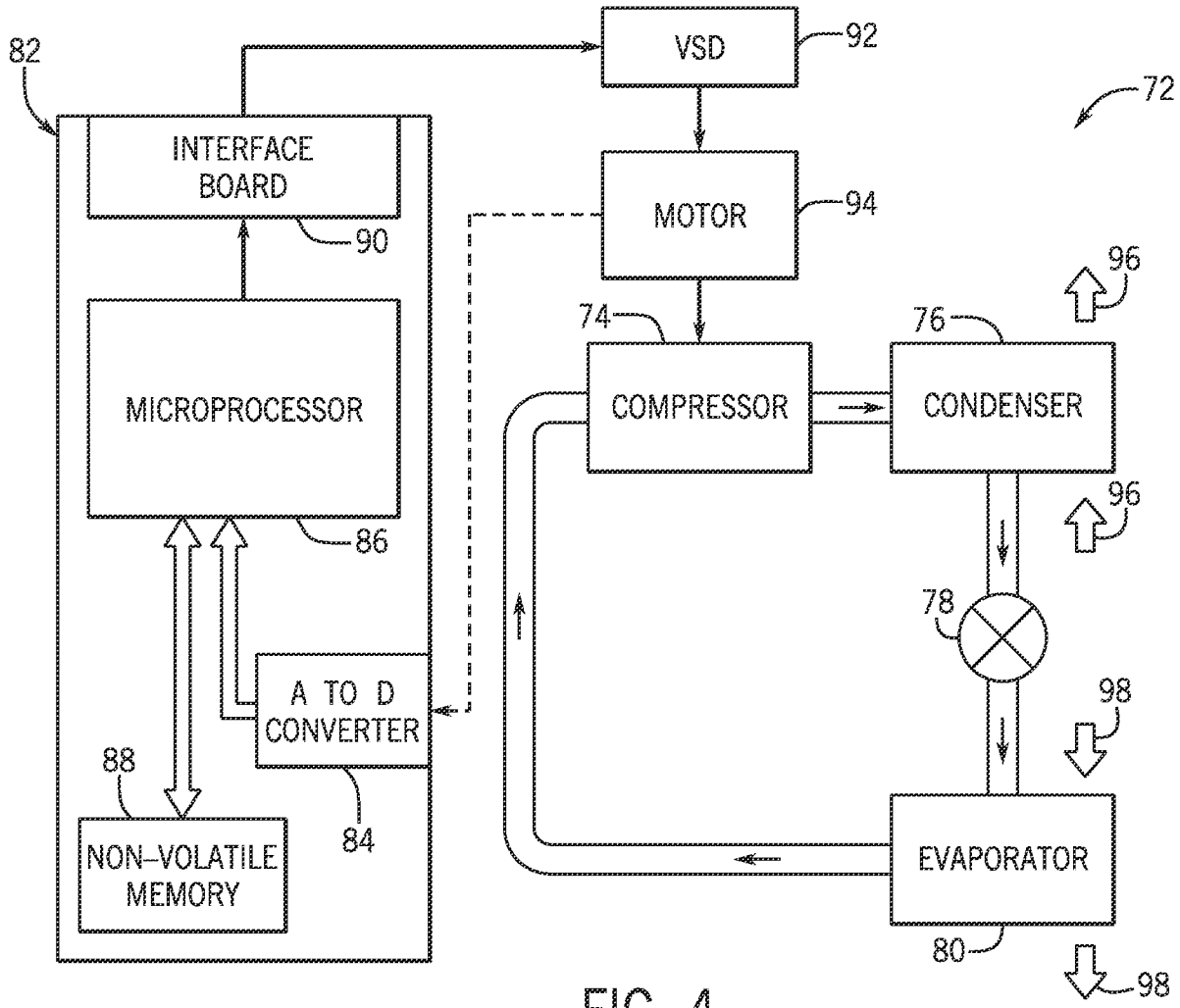
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
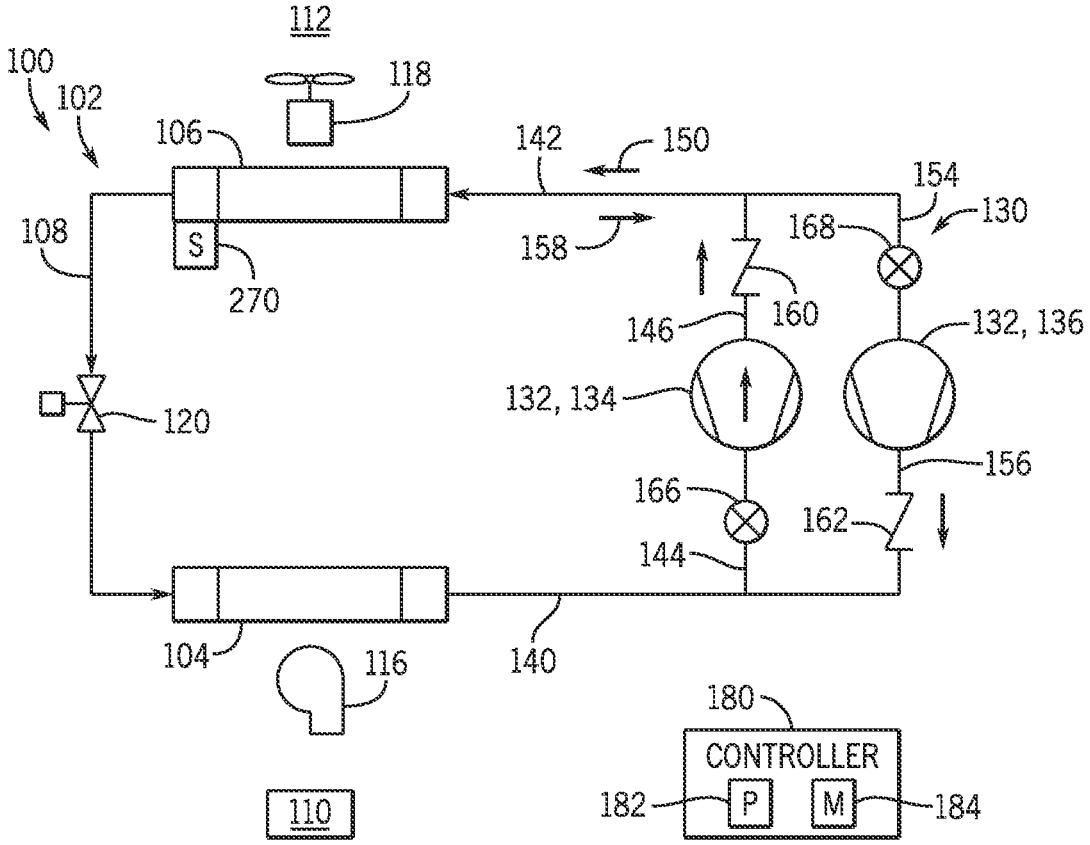
FIG. 5 is a schematic diagram of an embodiment of a portion of an HVAC system that includes a heat pump system, illustrating the heat pump system configured for operation in a cooling mode, in accordance with an aspect of the present disclosure.

As briefly discussed above, embodiments of the present disclosure are directed to an HVAC system having an improved heat pump system. To provide context for the following discussion, FIG. 5 is a schematic of an embodiment of a portion of an HVAC system 100 that includes a heat pump 102 (e.g., a heat pump system) in accordance with present embodiments. The heat pump 102 may include one or more components of the vapor compression system 72 discussed above and/or may be included in any of the systems described above (e.g., the HVAC unit 12, the heating and cooling system 50). The heat pump 102 includes a first heat exchanger 104 and a second heat exchanger 106 that are fluidly coupled to one another via a working fluid circuit 108 or working fluid loop (e.g., one or more conduits, refrigerant circuit, refrigerant loop). The first heat exchanger 104 may be in thermal communication with (e.g., fluidly coupled to) a thermal load 110 (e.g., a room, space, and/or device) serviced by the heat pump 102, and the second heat exchanger 106 may be in thermal communication with an ambient environment 112 (e.g., the atmosphere) surrounding the HVAC system 100.

In some embodiments, a first fan 116 (e.g., blower) may direct a first air flow across the first heat exchanger 104 to facilitate heat exchange between working fluid (e.g., refrigerant) within the first heat exchanger 104 and the thermal load 110, while a second fan 118 may direct a second air flow across the second heat exchanger 106 to facilitate heat exchange between working fluid within the second heat exchanger 106 and the ambient environment 112. An expansion device 120 (e.g., an electronic expansion valve [EEV], a bi-directional expansion valve) may be disposed along the working fluid circuit 108 between the first heat exchanger 104 and the second heat exchanger 106 and may be configured to regulate (e.g., throttle) a flow of working fluid and/or a working fluid pressure differential between the first and second heat exchangers 104, 106.

The heat pump 102 also includes a compressor system 130 disposed along the working fluid circuit 108. The compressor system 130 includes a plurality of compressors 132, such as a first compressor 134 and a second compressor 136, which, as discussed below, are each configured to direct working fluid flow through the first heat exchanger 104, the second heat exchanger 106, and remaining components (e.g., the expansion device 120) that may be fluidly coupled to the working fluid circuit 108. Although the compressor system 130 is shown as having two compressors 132 in the illustrated embodiment, the compressor system 130 may include any suitable quantity of compressors 132, such as two, three, four, five, six, or more than six compressors 132. For example, the first compressor 134 may be indicative of a compressor sub-system having two, three, four, five, six, or more than six compressors 132, and the second compressor 136 may be indicative of a compressor sub-system having two, three, four, five, six, or more than six compressors 132. One or more of the compressors 132 included in the compressor sub-systems may be fixed speed compressors, multi-stage (e.g., two stage) compressors, and/or variable speed compressors. As discussed below, any one or combination of the compressors 132 included in the compressor sub-systems may be activated and controlled in accordance with the presently disclosed techniques. In any case, the first compressor 134 and the second compressor 136 may be fluidly coupled to one another in a parallel configuration or a parallel arrangement (e.g., relative to a flow of working fluid through the compressors 132 and/or compressor system 130).

In the illustrated embodiment, the working fluid circuit 108 includes a first conduit 140 (e.g., one or more conduits) that extends between and/or from the first heat exchanger 104 to the compressor system 130 and includes a second conduit 142 (e.g., one or more conduits) that extends between and/or from the second heat exchanger 106 to the compressor system 130. A first suction conduit 144 extends between the first compressor 134 (e.g., a suction side of the first compressor 134) and the first conduit 140. A first discharge conduit 146 extends between the first compressor 134 (e.g., a discharge side of the first compressor 134) and the second conduit 142. Therefore, the first compressor 134 may be operable to draw (e.g., intake) a working fluid flow from the first conduit 140 (e.g., via the first suction conduit 144) and discharge (e.g., output) the working fluid flow to the second conduit 142 (e.g., via the first discharge conduit 146). As such, during certain operating modes of the heat pump 102, the first compressor 134 may receive a flow of working fluid from the first heat exchanger 104 and discharge a flow of the working fluid to the second heat exchanger 106. That is, the first compressor 134 may direct a working fluid flow through at least a portion of the working fluid circuit 108 in a first flow direction 150. As the working fluid flow is directed along the refrigerant circuit 108 in the first flow direction 150, the first compressor 134 enables the heat pump 102 to operate in a cooling mode, in which the first heat exchanger 104 absorbs thermal energy from the thermal load 110 to cool the thermal load 110, and the second heat exchanger 106 rejects the absorbed thermal energy (e.g., as absorbed from the thermal load 110) to the ambient environment 112.

In some embodiments, a second suction conduit 154 extends between the second compressor 136 (e.g., a suction side of the second compressor 136) and the second conduit 142. A second discharge conduit 156 extends between the second compressor 136 (e.g., a discharge side of the second compressor 136) and the first conduit 140. Therefore, the second compressor 136 may be operable to draw (e.g., intake) a working fluid flow from the second conduit 142 (e.g., via the second suction conduit 154) and discharge (e.g., output) the working fluid flow to the first conduit 140 (e.g., via the first discharge conduit 156). As such, during certain operating modes of the heat pump 102, the second compressor 136 may receive a flow of refrigerant from the second heat exchanger 106 and discharge a flow of working fluid to the first heat exchanger 104. That is, the second compressor 136 may direct a working fluid flow through at least a portion of the working fluid circuit 108 in a second flow direction 158, opposite to the first flow direction 150. In other words, the first compressor 134 and the second compressor 136 are arranged in parallel with one another and in opposite orientations relative to one another. As the working fluid flow is directed along the working fluid circuit 108 in the second flow direction 158, the second compressor 136 enables the heat pump 102 to operate in a heating mode, in which the second heat exchanger 106 absorbs thermal energy from the ambient environment 112, and the first heat exchanger 104 rejects the absorbed thermal energy (e.g., as absorbed from the ambient environment 112) to the thermal load 110 to heat the thermal load 110. In this way, the heat pump 102 having the first compressor 134 and the second compressor 136 is configured to operate with reduced greenhouse gas emissions by operating to heat and cool an air flow in an energy efficient manner and without operation of a furnace or other system that consumes a fuel.

Notably, switching between operation of the first compressor 134 and the second compressor 136 enables switching of an operational mode of the heat pump 102 between the cooling mode and the heating mode, respectively, without utilization of a reversing valve. As such, the heat pump 102 may exclude a reversing valve disposed along the working fluid circuit 108. That is, the heat pump 102 may not include a reversing valve disposed along or coupled to the first conduit 140, the second conduit 142, the first suction conduit 144, the first discharge conduit 146, the second suction conduit 154, and the second discharge conduit 156, for example.

In some embodiments, the compressor system 130 may include a first check valve 160 disposed along (e.g., coupled to) the first discharge conduit 146 and a second check valve 162 disposed along the second discharge conduit 158. The first check valve 160 may be configured to block flow of working fluid into and/or through the first compressor 134 in the second flow direction 158, and the second check valve 162 may be configured to block flow of working fluid into and/or through the second compressor 136 in the first flow direction 150.

The compressor system 130 may include a first control valve 166 disposed along (e.g., coupled to) the first suction conduit 144 and a second control valve 168 disposed along the second suction conduit 154. The first control valve 166 and the second control valve 168 may be selectively actuatable (e.g., based on control instructions) to enable or block flow of working fluid to the first compressor 134 and the second compressor 136, respectively. In some embodiments, the first control valve 166, the second control valve 168, or both, may be replaced with check valves (e.g., similar to the check valves 160 and 162). Additionally or alternatively, the first check valve 160, the second check valve 162, or both, may be replaced with control valves (e.g., similar to the control valves 166 and 168). Further, in certain embodiments, any or all of the first and second check valves 160, 162 and the first and second control valves 166, 168 may be omitted from the working fluid circuit 108. For example, in such embodiments, the first compressor 134 may include internal features (e.g., one or more valves or flow control devices) configured to block flow of working fluid in a reverse direction (e.g., the second flow direction 158) through the first compressor 134, and the second compressor 136 may include internal features (e.g., one or more valves or flow control devices) configured to block flow of working fluid in a reverse direction (e.g., the first flow direction 150) through the second compressor 136. In some embodiments, the first compressor 134, the second compressor 136, or both, may include high side shell (HSS) compressors. In other embodiments, the first compressor 134, the second compressor 136, or both, may include low side shell (LSS) compressors.

Figure 6:
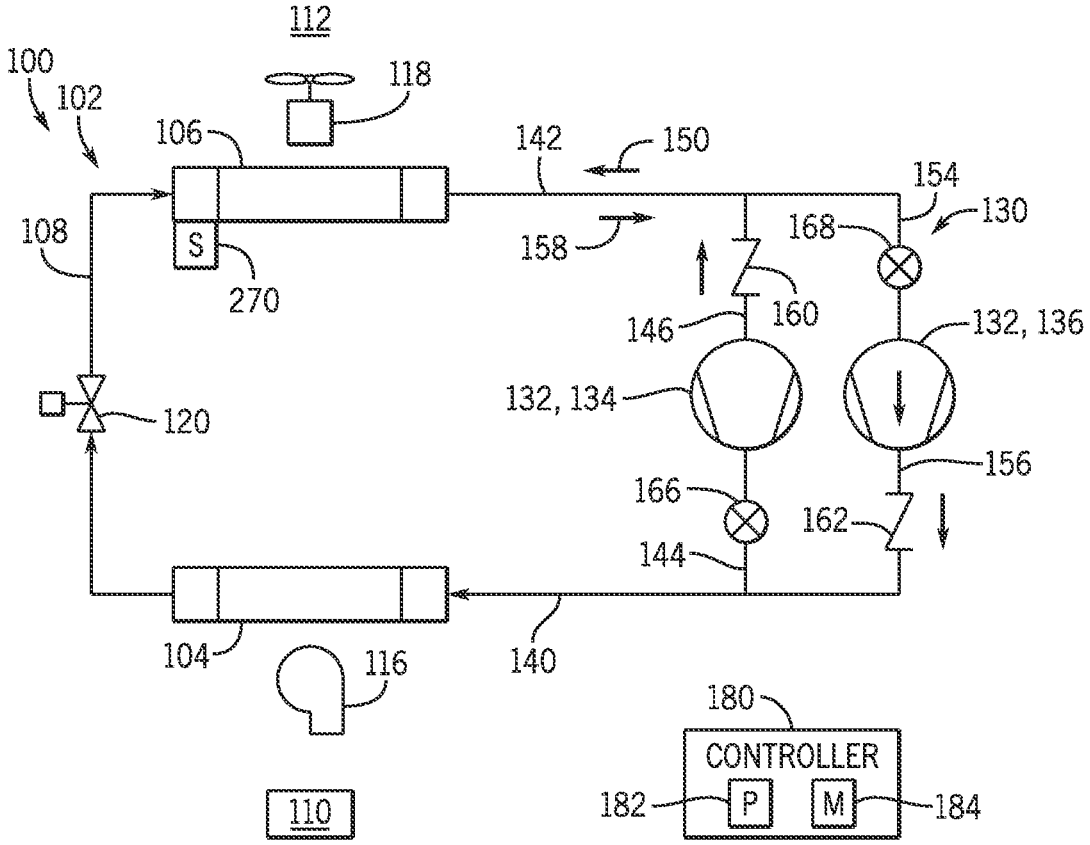
FIG. 6 is a schematic diagram of an embodiment of a portion of an HVAC system that includes a heat pump system, illustrating the heat pump system configured for operation in a heating mode, in accordance with an aspect of the present disclosure.

For clarity, the heat pump 102 is shown configured for operation in a cooling mode in the illustrated embodiment of FIG. 5, in which the first compressor 134 may be active (e.g., operational) to direct working fluid along the refrigerant circuit 108 in the first flow direction 150 while the second compressor 136 is idle (e.g., inactive). Moreover, FIG. 6 is a schematic of an embodiment of a portion of the HVAC system 100 illustrating the heat pump 102 configured for operation in a heating mode, in which the second compressor 136 may be active (e.g., operational) to direct working fluid along the working fluid circuit 108 in the second flow direction 158 while the first compressor 134 is idle (e.g., inactive). Throughout the following discussion, the first compressor 134 may also be referred to herein as a cooling compressor 134, and the second compressor 136 may also be referred to as a heating compressor 136.

The present discussion continues with reference to FIG. 5. In some embodiments, the cooling compressor 134 may include operational characteristics (e.g., volume ratio, volume index, volume geometry, etc.) that are tailored (e.g., selected) to enhance operation of the heat pump 102 in the cooling mode. The heating compressor 136 may include operational characteristics (e.g., volume ratio, volume index, volume geometry, etc.) that are tailored (e.g., selected) to enhance operation of the heat pump 102 in the heating mode. In other words, the cooling compressor 134 may include operational characteristics that enable the cooling compressor 134 to more efficiently direct working fluid (e.g., refrigerant) through the working fluid circuit 108 during operation of the heat pump 102 in the cooling mode (e.g., as compared to implementing the heating compressor 136 to direct working fluid through the working fluid circuit 108 in the first flow direction 150 in the cooling mode). The heating compressor 136 may similarly include operational characteristics that enable the heating compressor 136 to more efficiently direct working fluid (e.g., refrigerant) through the working fluid circuit 108 while the heat pump 102 operates in the heating mode (e.g., as compared to implementing the cooling compressor 134 to direct working fluid through the refrigerant circuit 108 in the second flow direction 158 in the heating mode). Thus, the heat pump 102 may operate in the cooling mode and in the heating mode with improved efficiency, reduced energy consumption, and greater overall HVAC system efficiency.

The operational characteristics of the compressors 132 may include respective volume indices or compression ratios of the compressors 132, respective capacities or displacements (e.g., swept volumes) of the compressors 132 (e.g., a volume of fluid ingested by the compressor 132 per revolution of the compressor 132), respective motor sizes (e.g., torque or power ranges) of motors of the compressors 132, and/or other suitable parameters of the compressors 132. In certain embodiments, the operational characteristics of the cooling compressor 134 and/or the heating compressor 136 may be selected based on a climatic region (e.g., a geographical location) in which the heat pump 102 is implemented. Moreover, in embodiments where the cooling compressor 134 includes a compressor sub-system having one or more compressors 132, the heating compressor 136 includes a compressor sub-system having one or more compressors 132, or both, it should be understood that each of the compressors 132 in the respective compressor sub-systems may be selected to enhance operation of the heat pump 102 in a particular mode (e.g., cooling, heating, defrost).

The HVAC system 100 may include a controller 180 (e.g., a control system, a thermostat, a control panel, control circuitry) that is communicatively coupled to one or more components of the heat pump 102 and is configured to monitor, adjust, and/or otherwise control operation of the components of the heat pump 102. For example, one or more control transfer devices, such as wires, cables, wireless communication devices, and the like, may communicatively couple the compressors 132, the expansion device 120, the first and/or second fans 116, 118, the control device 16 (e.g., a thermostat), and/or any other suitable components of the HVAC system 100 to the controller 180. That is, the compressors 132, the expansion device 120, the first and/or second fans 116, 118, and/or the control device 16 may each have one or more communication components that facilitate wired or wireless (e.g., via a network) communication with the controller 180. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressors 132, the expansion device 120, the first and/or second fans 116, 118, and/or the control device 16 may wirelessly communicate data between each other. In other embodiments, operational control of certain components of the heat pump 102 may be regulated by one or more relays or switches (e.g., a 24 volt alternating current [VAC] relay).

In some embodiments, the controller 180 may be a component of or may include the control panel 82. In other embodiments, the controller 180 may be a standalone controller, a dedicated controller, or another suitable controller included in the HVAC system 100. In any case, the controller 180 is configured to control components of the HVAC system 100 in accordance with the techniques discussed herein. The controller 180 includes processing circuitry 182, such as a microprocessor, which may execute software for controlling the components of the HVAC system 100. The processing circuitry 182 may include multiple microprocessors, one or more "general-purpose" microprocessors, one or more special-purpose microprocessors, and/or one or more application specific integrated circuits (ASICS), or some combination thereof. For example, the processing circuitry 182 may include one or more reduced instruction set (RISC) processors.

The controller 180 may also include a memory device 184 (e.g., a memory) that may store information, such as instructions, control software, look up tables, configuration data, etc. The memory device 184 may include a volatile memory, such as random access memory (RAM), and/or a nonvolatile memory, such as read-only memory (ROM). The memory device 184 may store a variety of information and may be used for various purposes. For example, the memory device 184 may store processor-executable instructions including firmware or software for the processing circuitry 182 execute, such as instructions for controlling components of the HVAC system 100. In some embodiments, the memory device 184 is a tangible, non-transitory, machine-readable-medium that may store machine-readable instructions for the processing circuitry 182 to execute. The memory device 184 may include ROM, flash memory, a hard drive, or any other suitable optical, magnetic, or solid-state storage medium, or a combination thereof. The memory device 184 may store data, instructions, and any other suitable data.

Figure 7:
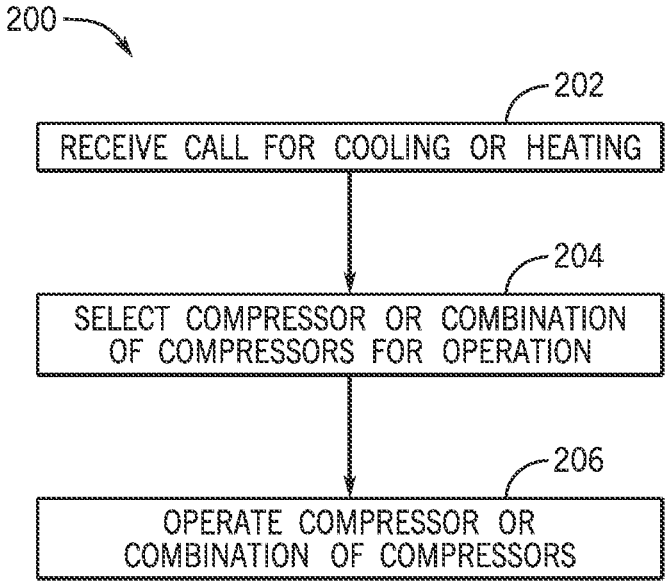
FIG. 7 is a flow diagram of an embodiment of a process for operating a heat pump system, in accordance with an aspect of the present disclosure.

To facilitate the following discussion, FIG. 7 is flow diagram of an embodiment of a process 200 for controlling the heat pump 102 in accordance with the presently disclosed techniques. FIG. 7 will be referenced concurrently with FIGS. 5 and 6 throughout the following discussion. It should be noted that the steps of the process 200 discussed below may be performed in any suitable order and are not limited to the order shown in the illustrated embodiment of FIG. 7. Moreover, it should be noted that additional steps of the process 200 may be performed, and certain steps of the process 200 may be omitted. In some embodiments, the process 200 may be executed by the processing circuitry 182 of the controller 180 and/or any other suitable processing circuitry of the HVAC system 100. The process 200 may be stored (e.g., as executable instructions) on, for example, the memory 88 or the memory device 184.

The process 200 may begin with receiving a call for cooling or heating, as indicated by block 202. For example, the controller 180 may receive a call (e.g., a control instruction) from the control device 16 or another suitable controller instructing the controller 180 to operate the heat pump 102 in the cooling mode to cool the thermal load 110 or in the heating mode to heat the thermal load 110. In response to receiving the call for cooling or heating, the controller 180 may select a corresponding compressor 132 or combination of compressors 132 to operate to satisfying a demand of the thermal load 110, as indicated by block 204, and may subsequently operate the compressor 132 or combination of compressors 132, as indicated by block 206.

For example, in response to receiving a call to operate the heat pump 102 in the cooling mode, the controller 180 may send control instructions to operate the cooling compressor 134 and to suspend or stay (e.g., block) operation of the heating compressor 136. As such, the controller 180 may operate the cooling compressor 134, which may be selected, designed, and/or optimized for operation of the heat pump 102 in the cooling mode, to circulate working fluid through the working fluid circuit 108 in the first flow direction 150, thereby enabling operation of the heat pump 102 in the cooling mode and facilitating cooling of the thermal load 110 in accordance with the techniques above. In response to receiving a call to operate the heat pump 102 in the heating mode, the controller 180 may send control instructions to operate the heating compressor 136 and to suspend or stay (e.g., block) operation of the cooling compressor 134. Accordingly, the controller 180 may operate the heating compressor 136, which may be selected, designed, and/or optimized for operation of the heat pump 102 in the heating mode, to circulate working fluid through the working fluid circuit 108 in the second flow direction 158, thereby enabling operation of the heat pump 102 in the heating mode and facilitating heating of the thermal load 110 in accordance with the techniques described herein.

In some embodiments, based on ambient conditions in the ambient environment 112, extended operation of the heat pump 102 in the heating mode may result in formation of ice or frost on the second heat exchanger 106. Such ice formation may reduce or block air flow across the second heat exchanger 106 (e.g., as induced by the second fan 118) and, thus, reduce an overall operational efficiency of the HVAC system 100. As such, the controller 180 may periodically operate the heat pump 102 in a defrost mode to melt any ice or frost that may accumulate on the second heat exchanger 106.

For example, in the heating mode, the controller 180 may operate the heating compressor 136 to circulate working fluid in the second flow direction 158, such that the expansion device 120 directs expanded, cooled working fluid to the second heat exchanger 106. In some embodiments, the controller 180 may determine accumulation of ice or frost on the second heat exchanger 106 based on feedback from a sensor 270 (e.g., temperature sensor, air flow sensor) coupled to or disposed adjacent the second heat exchanger 106. The sensor 270 may be configured to measure a temperature of the ambient environment 112, a temperature of a surface of the second heat exchanger 106, a flow rate or temperature of air flow across the second heat exchanger 106, or another suitable parameter. The controller 180 may initiate operation of the heat pump 102 in the defrost mode based on the feedback from the sensor 270. Additionally or alternatively, the controller 180 may initiate operation in the defrost mode upon lapse of a predetermined time period, at a predetermined time interval, and/or in response to other control instructions that may be received by the controller 180.

In some embodiments, to initiate the defrost mode, the controller 180 may deactivate the heating compressor 136 and may activate the cooling compressor 134. As such, the cooling compressor 134 may direct compressed, heated working fluid to the second heat exchanger 106 to effectuate heating of the second heat exchanger 106 and melting of ice or frost that may be accumulated on the second heat exchanger 106. In some embodiments, the controller 180 may activate the cooling compressor 134 at substantially the same time (e.g., within 1 second) of deactivating the heating compressor 136. In certain embodiments, the controller 180 may initiate a timer (e.g., execute a time delay) to delay activation of the cooling compressor 134 by a predetermined time interval (e.g., 2 seconds, seconds, 10 seconds, 1 minute) upon deactivation (e.g., suspending operation) of the heating compressor 136. As such, the controller 180 may enable working fluid pressure differentials across certain components of the working fluid circuit 108 to equalize or reduce prior to activation of the cooling compressor 134 in the defrost mode. In some embodiments, the controller 180 may adjust the expansion device 120 (e.g., instruct the expansion device 120 to transition to an open position, such as a fully open position) during the predetermined time interval to facilitate working fluid flow and pressure equalization across the expansion device 120 during the predetermined time interval. The controller 180 may return the expansion device 120 to a partially closed or restricted positon prior to activation of the cooling compressor 134. Additionally or alternatively, the controller 180 may adjust operation (e.g., adjust a speed of) of the first fan 116, the second fan 118, or both, in a manner that facilitates pressure equalization along the working fluid circuit 108 during the predetermined time interval.

Figure 8:
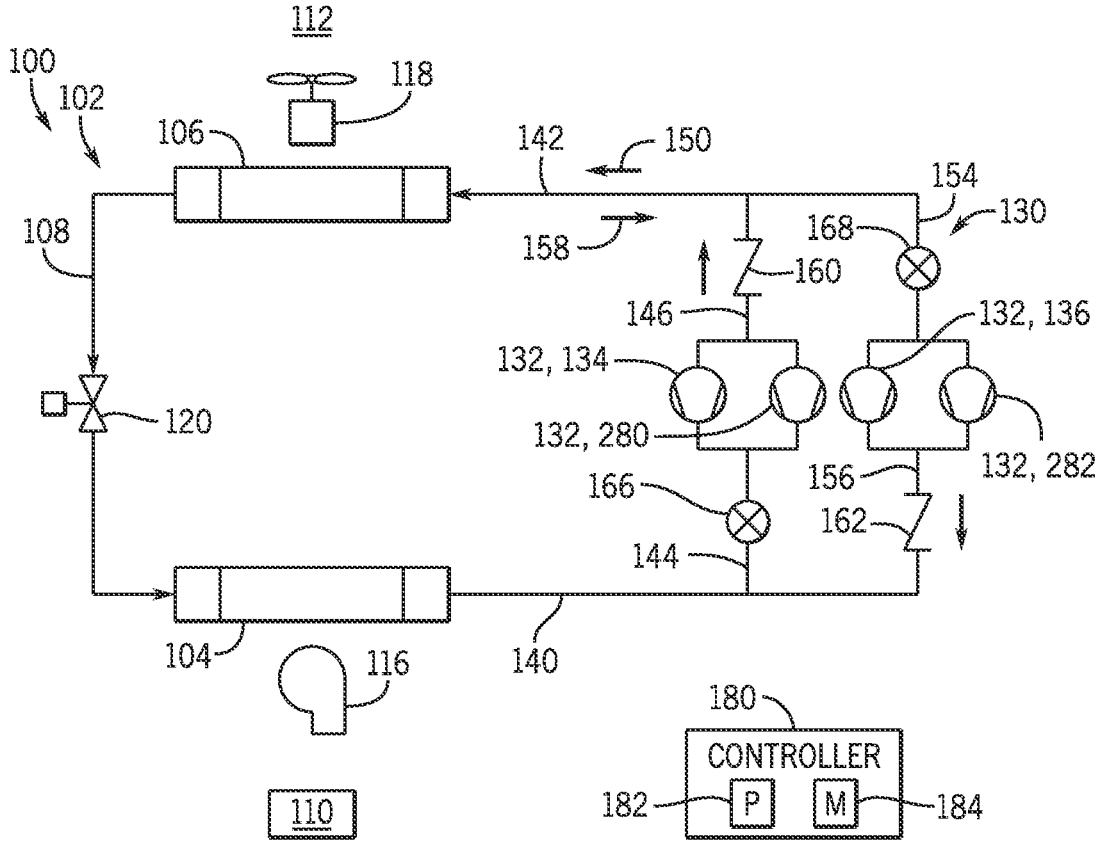
FIG. 8 is a schematic diagram of an embodiment of a portion of an HVAC system that includes heat pump system having compressor sub-systems, in accordance with an aspect of the present disclosure.

FIG. 8 is a schematic of an embodiment of the heat pump 102, in which the compressor system 130 includes the cooling compressor 134 and an auxiliary cooling compressor 280 coupled to the first suction conduit 144 and includes the heating compressor 136 and an auxiliary heating compressor 282 coupled to the second suction conduit 154. The cooling compressor 134 and the auxiliary cooling compressor 280 may be referred to herein as cooling compressors 132 (e.g., a compressor sub-system) and the heating compressor 136 and the auxiliary heating compressor 282 may be referred to herein as heating compressors 132 (e.g., a compressor sub-system). In some embodiments, the controller 180 may designate a particular one or combination of the cooling compressors 132 or the heating compressors 132 for operation in a manner that enhances an overall operational efficiency of the HVAC system 100 (e.g., increased energy efficiency, reduced energy consumption) while the heat pump 102 operates in either the cooling mode or the heating mode, respectively, and may activate the selected compressor 132 or combination of compressors 132 based on the designation.

As an example, in some embodiments, the controller 180 may determine that a call for multi-compressor operation exists in response to receiving feedback or data from the control device 16 indicative of a temperature indicative of or within the thermal load 110 (e.g., an air temperature in the thermal load 110) deviating from a target temperature set-point for the thermal load 110 (e.g., by a threshold amount and/or by a threshold percentage). That is, controller 180 may be configured to determine whether to operate one or more of the compressors 132 (e.g., one or more of the cooling compressors 132, one or more of the heating compressor 132) based on a demand (e.g., a magnitude of a demand, a demand level) for conditioning (e.g., heating, cooling). For example, the controller 180 may determine that multi-compressor operation is desired in response to determining that a heating demand (e.g., demand level) of the thermal load 110 is relatively high, such as when the temperature indicative of or within the thermal load 110 is below the target temperature set-point for the thermal load 110 by the threshold amount. Additionally or alternatively, the controller 180 may determine that multi-compressor operation is desired based on a time of day at which the call for heating is received, based on an occupancy within the thermal load 110 at the time the call for heating is received, based on ambient atmospheric conditions surrounding the HVAC system 100 at the time the call for heating is received, based on a suction pressure of the compressor system 130, based on a discharge pressure of the compressor system 130, and/or based on an operational speed of the fans 116 and/or 118.

In any case, in response to determining that a call for heating exists and that multi-stage compressor operation is not desired, the controller 180 may send instructions to operate the heating compressor 136 while retaining the auxiliary heating compressor 282 and the cooling compressors 134 in an idle state. In response to determining that a call for heating exists and that multi-stage compressor operation is desired, the controller 180 may send instructions to operate both the heating compressor 136 and the auxiliary heating compressor 282 while retaining the cooling compressors 132 in the idle state.

The controller 180 may stage operation of the cooling compressors 132 in a similar manner to the staging of the heating compressors 132. As such, the controller 180 may determine a demand level of the thermal load 110 and may, based on the determined demand level of the thermal load 110, determine whether to operate one or multiple of the cooling compressors 132. The controller 180 may similarly determine which of the multiple cooling compressors 132 to operate based on any of the operating parameters discussed above.

In embodiments where the compressor system 130 includes more than two cooling compressors 132 and/or more than two heating compressors 132, the controller 180 may selectively activate or deactivate any one or combination of the cooling compressors 132 and/or the heating compressors 132 based on an instant cooling demand or heating demand, respectively, of the thermal load 110 and/or based on one or more measured operational parameters of the HVAC system 100 to enable the heat pump 102 to adequately satisfy the cooling or heating demand of the thermal load 110 with improved efficiency (e.g., increased energy efficiency, reduced energy consumption). For example, the controller 180 may be configured to sequentially activate one, two, three, four, five, six, or more than six cooling compressors 132 of the compressor system 130 based on the current cooling demand of the thermal load 110 and/or based on one or more measured operational parameters of the HVAC system 100 to enable the heat pump 102 to adequately satisfy the cooling demand of the thermal load 110 with improved efficiency. Similarly, the controller 180 may be configured to sequentially activate one, two, three, four, five, six, or more than six heating compressors 132 of the compressor system 130 based on an instant heating demand of the thermal load 110 and/or based on one or more measured operational parameters of the HVAC system 100 to enable the heat pump 102 to adequately satisfy the heating demand of the thermal load 110 with improved efficiency (e.g., increased energy efficiency, reduced energy consumption). Moreover, in certain embodiments, one or more of the compressors 132 may include multi-stage compressors 132 or variable speed compressors 132. In such embodiments, the controller 180 may be configured to selectively adjust stages of one or more of the compressors 132 and/or speeds of one or more of the compressors 132 in a manner that enables the heat pump 102 to adequately satisfy the cooling or heating demand of the thermal load 110 with improved efficiency. The controller 180 may be configured to adjust operation of the compressors 132 in accordance with the aforementioned techniques based on sensor feedback, control instructions received from other control devices of the HVAC system 100, user input provided via a user interface of the HVAC system 100, and/or based on other suitable control instructions received by the controller 180.

Figure 9:
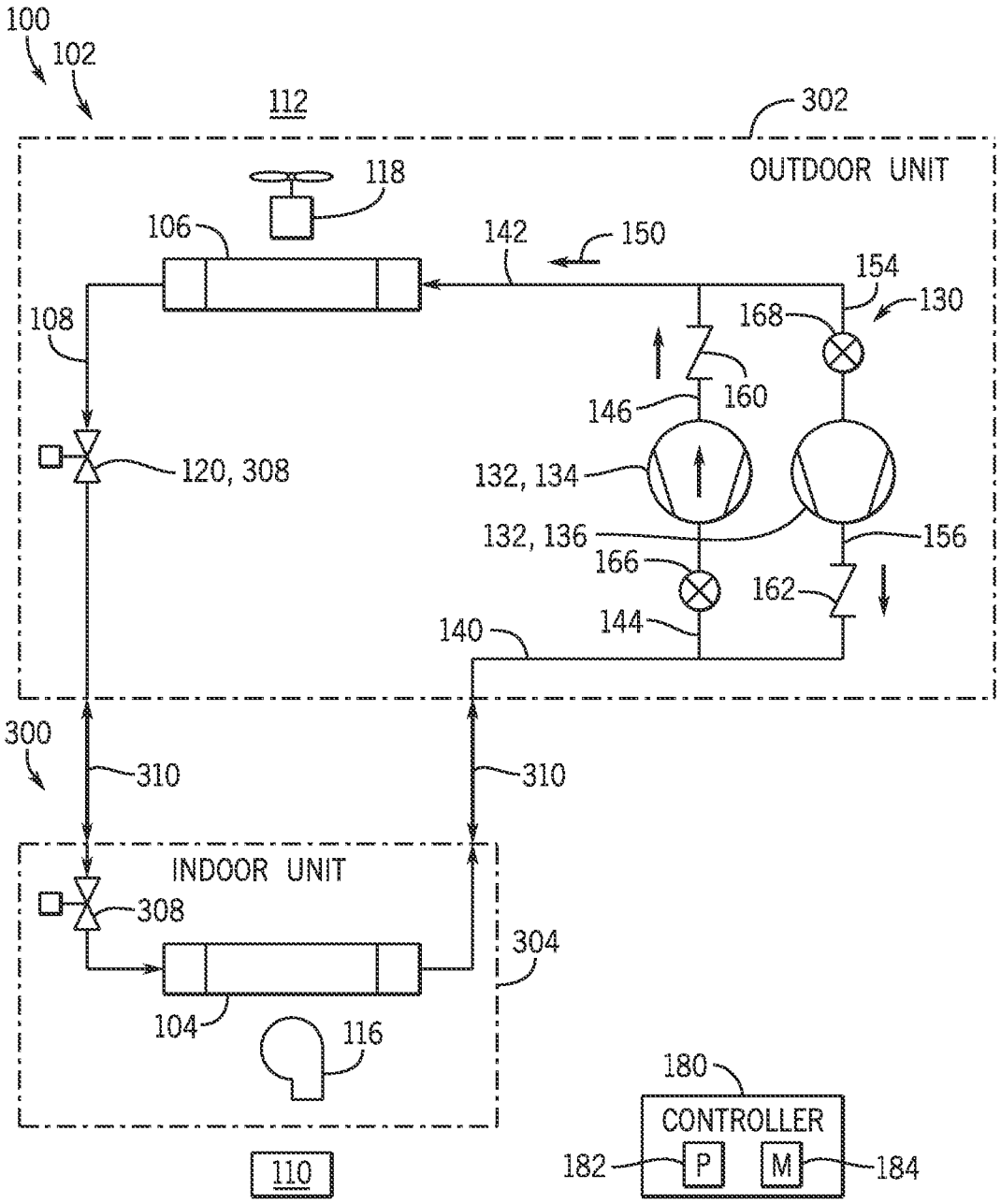
FIG. 9 is a schematic diagram of an embodiment of a portion of an HVAC system that includes a split heat pump system, illustrating the split heat pump system configured for operation in a cooling mode, in accordance with an aspect of the present disclosure.

FIG. 9 is a schematic of an embodiment of the HVAC system 100, illustrating the heat pump 102 in a split configuration 300. In the split configuration 300, the heat pump 102 may include an outdoor unit 302 having the compressor system 130, the expansion device 120, the second fan 118, and/or the second heat exchanger 106, for example. Moreover, in the split configuration 300, the heat pump 102 may include an indoor unit 304 having the first heat exchanger 104 and the first fan 116, for example. Thus, the outdoor unit 302 and the indoor unit 304 may include portions of the HVAC system 100 that are disposed at different locations with respect to one another. In particular, the outdoor unit 302 may be positioned in the ambient environment 112, while the indoor unit 304 may be positioned within the thermal load 110 and/or adjacent to the thermal load 110 (e.g., a room or area adjacent to the space conditioned by the HVAC system 100). In some embodiments, the expansion device 120 may be included in the indoor unit 304 instead of the outdoor unit 302. In certain embodiments, the heat pump 102 may include a pair of expansion devices 308 that may be configured to operate independently or cooperatively. In some embodiments, one of the expansion devices 308 is included in the outdoor unit 302 and another of the expansion devices 308 is included in the indoor unit 304.

Figure 10:
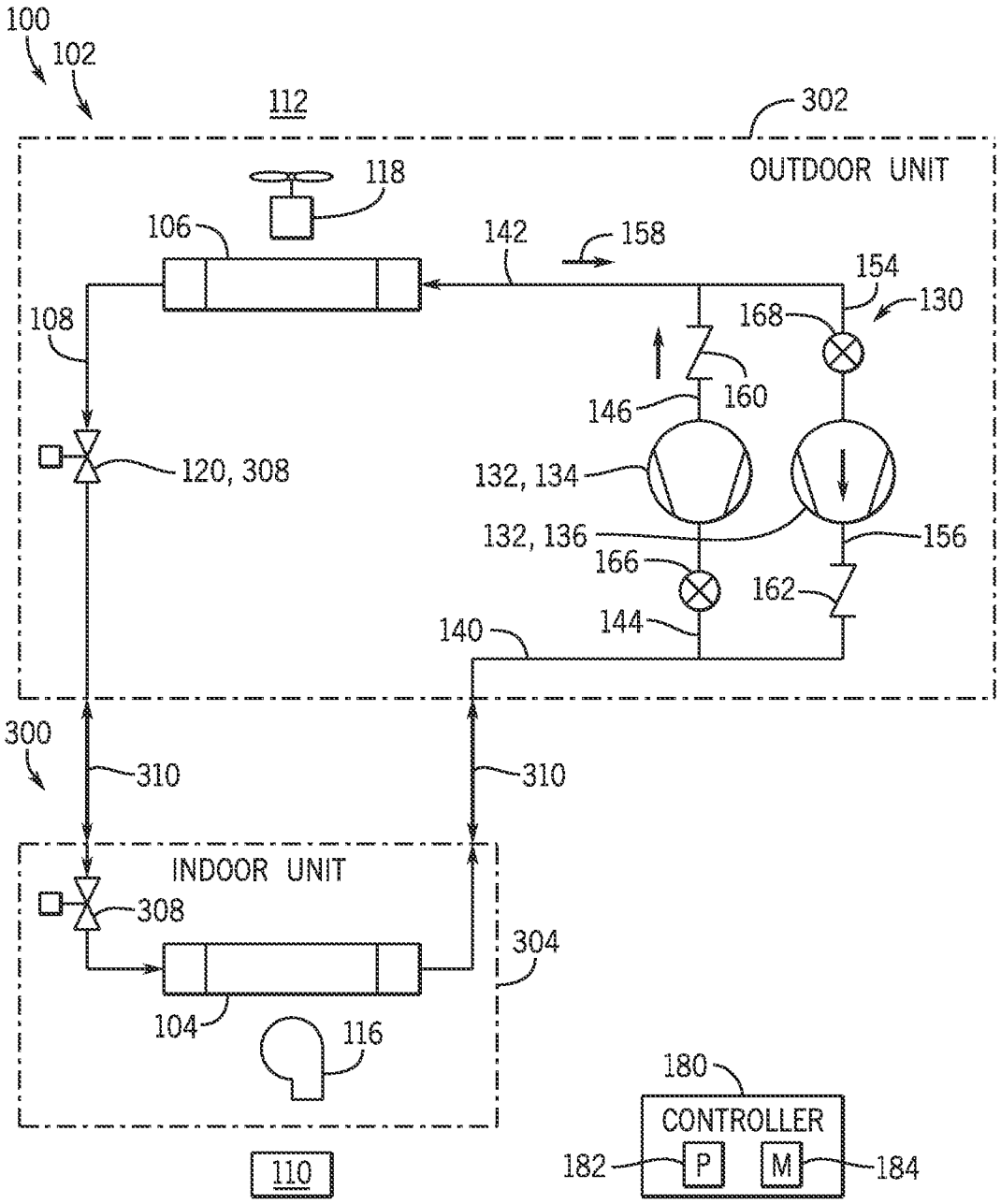
FIG. 10 is a schematic diagram of an embodiment of a portion of an HVAC system that includes a split heat pump system, illustrating the split heat pump system configured for operation in a heating mode, in accordance with an aspect of the present disclosure.

A portion of the working fluid circuit 108 included in the outdoor unit 302 may be fluidly coupled to a remaining portion of the working fluid circuit 108 included in the indoor unit 304 via connection portions 310 (e.g., conduits) of the working fluid circuit 108. In the illustrated embodiment, the cooling compressor 134 is active (while the heating compressor 136 is idle) to direct working fluid in the first flow direction 150 along at least a portion of the working fluid circuit 108 to enable operation of the heat pump 102 in the cooling mode. FIG. 10 is a schematic of an embodiment of the heat pump 102 in the split configuration 300, in which the cooling compressor 134 is idle and the heating compressor 136 is active, thereby enabling operation of the heat pump 102 in the heating mode. That is, in the heating mode, the heating compressor 136 may direct the working fluid in the second flow direction 158 along at least a portion of the working fluid circuit 108.

As set forth above, embodiments of the present disclosure may provide one or more technical effects useful for selectively enabling operation of a heat pump system in both a cooling mode or a heating mode without implementation of a reversing valve in the heat pump system. Implementation of the disclosed heat pump system without a reversing valve may improve an overall operational efficiency of an HVAC system during cooling and heating operations, as well as reduce costs and complexity associated with operation and/or maintenance of the HVAC system. Further, the disclosed techniques include heat pumps with different compressors that are operated in different operating modes, where the different compressors include respective characteristics tailored for more efficient in a corresponding operating mode. Indeed, present embodiments may operate in a cooling mode and in a heating mode with improved heat transfer efficiency, improved energy efficiency, and/or reduced energy consumption. Indeed, the HVAC systems disclosed herein are configured to operate with reduced greenhouse gas emissions by operating to heat and cool an air flow in an energy efficient manner and without operation of a furnace or other system that consumes a fuel. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heat pump for a heating, ventilation, and air conditioning (HVAC) system, comprising:

a compressor system configured to direct a working fluid flow along a working fluid circuit of the energy efficient heat pump, wherein the compressor system comprises:

a first compressor configured to direct the working fluid flow in a first direction along the working fluid circuit; and a second compressor configured to direct the working fluid flow in a second direction along the working fluid circuit, opposite the first direction; and a controller communicatively coupled to the first compressor and the second compressor, wherein the controller is configured to:

operate the first compressor and suspend operation of the second compressor in a cooling mode of the energy efficient heat pump;

operate the second compressor and suspend operation of the first compressor in a heating mode of the energy efficient heat pump; and operate the first compressor and suspend operation of the second compressor in a defrost mode of the energy efficient heat pump to adjust flow of the working fluid flow from the second direction along the working fluid circuit to the first direction along the working fluid circuit.

2. The energy efficient heat pump of claim 1, comprising one or more conduits fluidly coupling a first heat exchanger and a second heat exchanger of the energy efficient heat pump to the compressor system, wherein the energy efficient heat pump excludes a reversing valve along the one or more conduits.

3. The energy efficient heat pump of claim 1, wherein the first compressor and the second compressor are arranged in parallel with one another relative to flow of the working fluid flow through the compressor system.

4. The energy efficient heat pump of claim 1, wherein the first compressor comprises a first volume index and the second compressor comprises a second volume index different from the first volume index.

5. The energy efficient heat pump of claim 1, comprising a first check valve disposed along the working fluid circuit downstream of the first compressor, wherein the first check valve is configured to block flow of the working fluid flow through the first compressor in the second direction.

6. The energy efficient heat pump of claim 1, comprising a second check valve disposed along the working fluid circuit downstream of the second compressor, wherein the second check valve is configured to block flow of the working fluid flow through the second compressor in the first direction.

7. The energy efficient heat pump of claim 1, wherein the compressor system comprises a third compressor and a fourth compressor, the third compressor is configured to direct the working fluid flow in the first direction along the working fluid circuit to operate the energy efficient heat pump in the cooling mode, and the fourth compressor is configured to direct the working fluid flow in the second direction along the working fluid circuit to operate the energy efficient heat pump in the heating mode.

8. The energy efficient heat pump of claim 7, wherein the first compressor and the third compressor are arranged in parallel with one another relative to flow of the working fluid flow through the compressor system in the first direction, and wherein the second compressor and the fourth compressor are arranged in parallel with one another relative to flow of the working fluid flow through the compressor system in the second direction.

9. The energy efficient heat pump of claim 7, wherein the controller is configured to selectively operate the first compressor, the third compressor, or both based on a cooling demand level in the cooling mode, and the controller is configured to selectively operate the second compressor, the fourth compressor, or both based on a heating demand level in the heating mode.

10. An energy efficient heat pump, comprising:

a working fluid circuit;

a first compressor disposed along the working fluid circuit, wherein the first compressor is configured to direct a working fluid along the working fluid circuit in a first direction in a first operating mode of the energy efficient heat pump;

a second compressor disposed along the working fluid circuit, wherein the second compressor is configured to direct the working fluid along the working fluid circuit in a second direction in a second operating mode of the energy efficient heat pump, wherein the first compressor and the second compressor are arranged in parallel with one another relative to a flow of the working fluid along the working fluid circuit, and wherein the first direction is opposite the second direction; and a controller configured to operate the first compressor and the second compressor, wherein the controller is configured to execute a time delay subsequent to suspending operation of the first compressor and prior to initiating operation of the second compressor, execute the time delay subsequent to suspending operation of the second compressor and prior to initiating operation of the first compressor, or both.

11. The energy efficient heat pump of claim 10, wherein the first operating mode is a cooling mode of the energy efficient heat pump, and the second operating mode is a heating mode of the energy efficient heat pump.

12. The energy efficient heat pump of claim 11, wherein the controller is configured to:

operate the first compressor and suspend operation of the second compressor in the cooling mode; and operate the second compressor and suspend operation of the first compressor in the heating mode.

13. The energy efficient heat pump of claim 12, wherein the controller is configured to operate the first compressor and suspend operation of the second compressor in a defrost operating mode of the energy efficient heat pump.

14. The energy efficient heat pump of claim 10, wherein the working fluid circuit does not include a reversing valve.

15. The energy efficient heat pump of claim 10, comprising an expansion device disposed along the working fluid circuit, wherein the controller is configured to adjust the expansion device to an open position during the time delay to facilitate pressure equalization across the expansion device.

16. The energy efficient heat pump of claim 10, comprising:

a heat exchanger disposed along the working fluid circuit; and a fan configured to direct an air flow across the heat exchanger, wherein the controller is configured to adjust a speed of the fan during the time delay to facilitate pressure equalization along the working fluid circuit.

17. An energy efficient heat pump for a heating, ventilation, and air conditioning (HVAC) system, comprising:

a first compressor disposed along a working fluid circuit and configured to direct a working fluid through the working fluid circuit in a first direction;

a second compressor disposed along the working fluid circuit and configured to direct the working fluid through the working fluid circuit in a second direction, opposite the first direction, wherein the first compressor and the second compressor are arranged in parallel with one another relative to a flow of the working fluid along the working fluid circuit; and a controller configured to:

operate the first compressor and suspend operation of the second compressor in a cooling mode of the energy efficient heat pump;

operate the second compressor and suspend operation of the first compressor in a heating mode of the energy efficient heat pump; and operate the first compressor and suspend operation of the second compressor in a defrost mode of the energy efficient heat pump to adjust flow of the working fluid through the working fluid circuit from the second direction to the first direction.

18. The energy efficient heat pump of claim 17, wherein the first compressor comprises a first volume index and the second compressor comprises a second volume index different from the first volume index.

19. The energy efficient heat pump of claim 17, comprising:

a first valve disposed along the working fluid circuit and configured to block flow of the working fluid through the first compressor in the heating mode; and a second valve disposed along the working fluid circuit and configured to block flow of the working fluid through the second compressor in the cooling mode.

20. The energy efficient heat pump of claim 17, comprising the working fluid circuit, wherein the working fluid circuit does not include a reversing valve.

* * * * *